United States Patent [19]

Marzábal Martínez

[11] Patent Number: 4,638,918

[45] Date of Patent: Jan. 27, 1987

[54] BOTTLE STOPPER

[75] Inventor: Carlos Marzábal Martínez, Barcelona, Spain

[73] Assignee: Antonio Puig, S.A., Barcelona, Spain

[21] Appl. No.: 807,255

[22] Filed: Dec. 10, 1985

[30] Foreign Application Priority Data

Feb. 19, 1985 [ES] Spain ..... 540.507

[51] Int. Cl.[4] ..... B65D 41/18; B65D 41/34

[52] U.S. Cl. ..... 215/295; 215/320; 215/331; 215/334

[58] Field of Search ..... 215/295, 318, 320, 331, 215/334

[56] References Cited

U.S. PATENT DOCUMENTS

| | | | |
|---|---|---|---|
| 2,532,729 | 12/1950 | Millstein | 215/331 X |
| 2,689,665 | 9/1954 | Martin | 215/334 |
| 3,199,704 | 8/1965 | Davidson | 215/334 |
| 4,244,480 | 1/1981 | Planas | 215/334 X |

FOREIGN PATENT DOCUMENTS

| | | | |
|---|---|---|---|
| 1260128 | 1/1972 | United Kingdom | 215/295 |

*Primary Examiner*—Donald F. Norton

*Attorney, Agent, or Firm*—Scully, Scott, Murphy & Presser

[57] ABSTRACT

A bottle stopper comprising a cap shaped outer body member having an axial shank extending from the bottom of the stopper and an inner body member comprising in turn a portion for attachment to the outer body member and a hollow sealing member in which the shank is inserted and which is adapted to be inserted in the bottle neck. Between the attachment portion and the hollow sealing member, there is a plurality of bridge members connecting both members. Means are also provided in the inner body member to mate with further means on the neck to limit the insertion of the hollow member in the neck and said means also limit the rotation of the stopper on the bottle.

11 Claims, 10 Drawing Figures

BOTTLE STOPPER

BACKGROUND OF THE INVENTION

This invention relates to a stopper for bottles. In particular the invention relates to a stopper for bottles having a neck and which are of the type comprising a cap shaped outer body member provided with a lateral skirt portion, a base and an axial shank extending from the inner surface of the base in the centre thereof and a resilient inner body member comprising a portion for attachment with the outer body member and a hollow sealing member in which there is inserted the said axial shank and which is adapted to be inserted in the neck.

DESCRIPTION OF THE PRIOR ART

The known stoppers of the above described type provide a good seal for the corresponding bottle, since the hollow sealing member, guided by the axial shank which prevents the hollow member from deforming, is inserted in the neck and snugly engages the inside of the neck.

Nevertheless, the guiding by way of the shank makes the sealing member rather unversatile and, therefore, when the inside of the neck is not properly centered and/or has an oval orifice, it becomes hard to apply the sealing member properly to the inside of the neck.

SUMMARY OF THE INVENTION

This drawback is overcome with the stopper of the invention which, being of the above described type, is characterised in that between said attachment portion and said hollow sealing member there is provided a plurality of bridge members forming or helping to form the connection between said portion and said member.

With this configuration, certain bridge members may give way differently from others and therefore the sealing member may adapt itself to the inside of the neck although the orifice is offset or not properly circular.

According to the invention, said bridge portions are preferably of inverted U shape in cross section, having a first leg upwardly directed towards the base of the outer body member and a second leg downwardly directed towards the sealing member.

The U-shaped loop formed by said bridge members increases the possibilities of variation in the way the bridge members give way and consequently also increases the capacity of adaptation of the sealing member.

In a further development of the invention, each second leg of said bridge members is generally extended into the hollow sealing member itself.

According to a further embodiment of the invention, said attachment portion is formed by a skirt portion snugly adjacent the inner surface of said outer body member and has a generally cylindrical inner surface.

During the insertion of the sealing member in the neck, the member is restrained at the same time as it is urged by the end of the axial shank. Therefore, if said shank pushes the sealing member too far, stresses are set up in the sealing member which may cause damage thereto. Consequently, there is appreciated the desirability of limiting the insertion of the stopper in the neck and this is achieved according to the invention by having the inner surface of the inner body member skirt portion provided with inwardly directed means adapted to engage thread means on the bottle neck, said neck also being provided with at least one axial rib adapted to act as a stop and limit the rotation of said inwardlly directed means.

Alternatively, according to the invention, said inwardly directed means may be a thread or comprise one or several segments of an annular thread.

Also said thread means may either comprise a single helical thread or several helical threads spaced apart by a number of degrees resulting from dividing 360° by the number of threads.

Optionally according to the invention, the inner surface of the inner body member skirt portion is provided with at least two generally axially saw-toothed shaped protuberances adapted to engage an annular recess of the bottle neck, said neck also being provided with a undulating peripheral shelf adapted to engage the free edge of the skirt portion, which also has an undulating configuration.

BRIEF DESCRIPTION OF THE DRAWINGS

The invention will be described now by way of example only with particular reference to the accompanying drawings. In the drawings.

DESCRIPTION OF THE PREFERRED EMBODIMENTS

Figure 1:
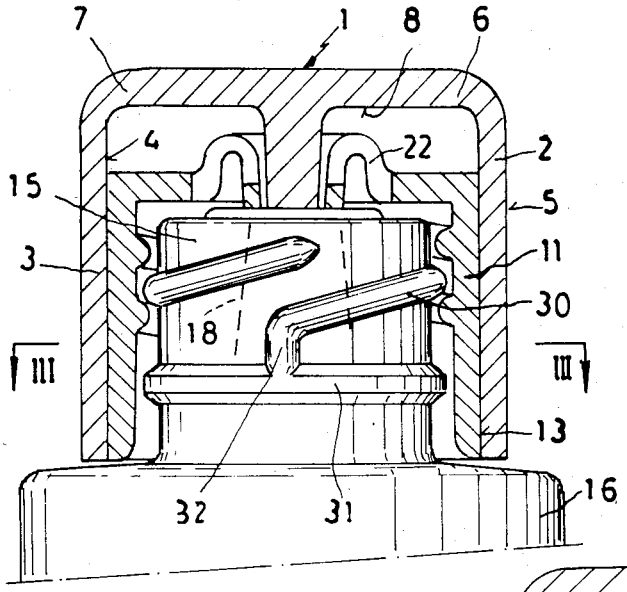
FIG. 1 is a cross sectional view of a stopper applied to a bottle neck shown in side elevation.
Figure 2:
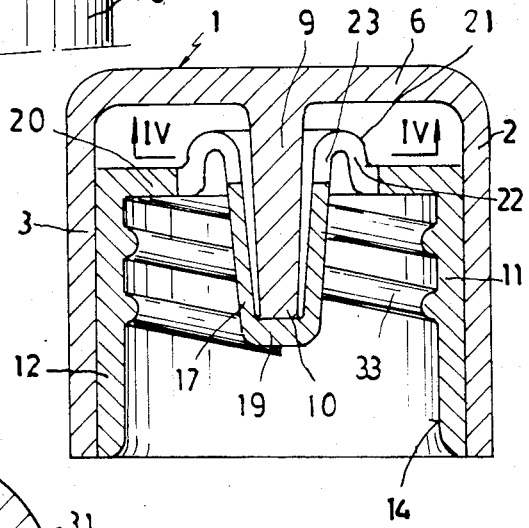
FIG. 2 is an axial sectional view of the stopper removed from the bottle.
Figure 3:
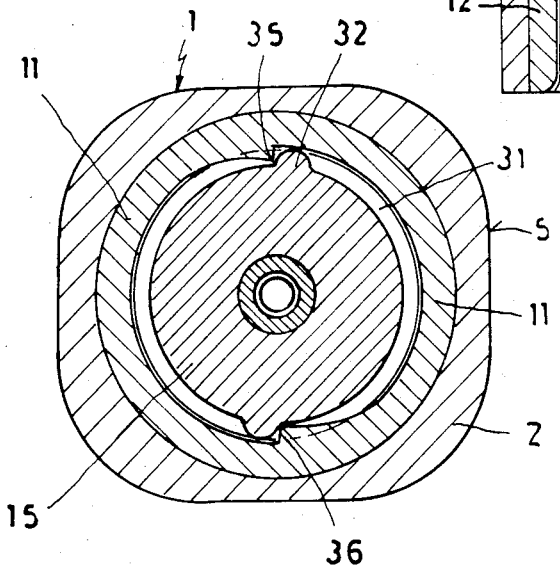
FIG. 3 is a cross sectional view along the line III—III of FIG. 1.
Figure 5:
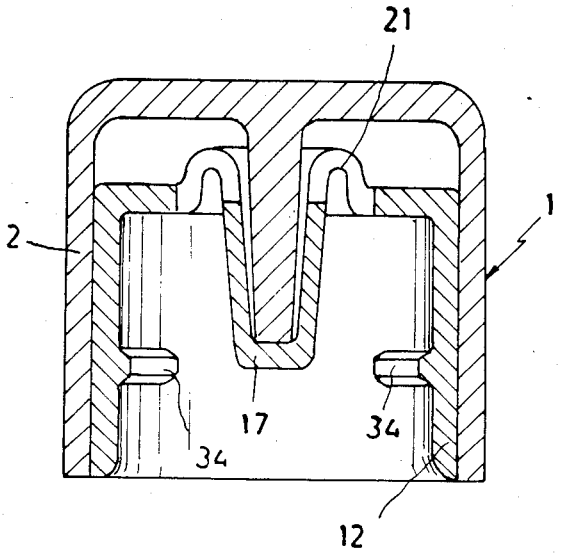
FIG. 5 is a cross sectional view, similar to FIG. 2, showing a stopper in which the inwardly directed means are segments of an annular thread.
Figure 4:
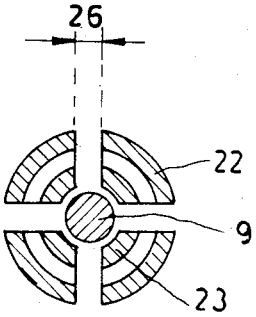
FIG. 4 is a cross sectional view along the line IV—IV of FIG. 2.
Figure 6:
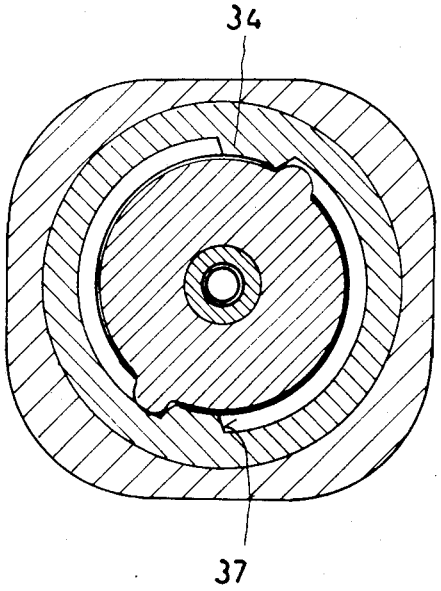
FIG. 6 is a cross sectional view similar to FIG. 3 corresponding to the stopper of FIG. 5.
Figure 7:
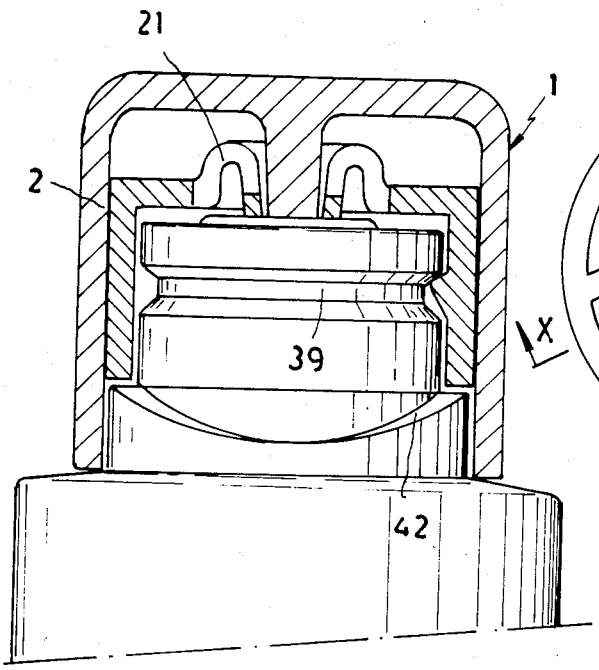
FIG. 7 is an axial cross sectional view of an alternative embodiment of the stopper fitted to the neck of a bottle shown in side elevation.

The present stopper 1 comprises a cap shaped outer body member 2 and is provided with a lateral skirt portion 3 which may have any shape compatible with its intended purpose. In the embodiments illustrated, the skirt portion has a substantially cylindrical inner surface 4 and an outer surface 5 having the shape of a square prism with rounded corners; the outer surface 5 is for ornamental purposes and the shape thereof is therefore not important.

The lateral skirt portion 3 extends from a base 6 to which it is preferably attached over a transition region 7 which is also curved. From the inner surface 8 of the base 6 there extends an axial shank 9 positioned in the centre of the base. The shank is preferably cylindrical or conical and the free end 10 thereof is flat or slightly convex.

The outer body member 2 is fixedly attached to an inner body member of resilient material and such attachment is effected by conventional means such as, for example, by adhesives, press fit, mating irregularities on the inner and outer body members or other means.

The inner body member 11 comprises a portion for attachment with the outer body member and preferably such attachment portion comprises a skirt portion 12, the outer surface 13 of which is shaped for adaptation to the inner surface 4 of the outer body member allowing such attachment, while the inner surface 14 thereof is substantially cylindrical and is provided with means for engaging the stopper 1 with the neck 15 of the bottle 16, to which reference wil be made hereinafter.

Notwithstanding, it is also contemplated that the attachment portion of the inner body member is different from the skirt portion 12. The attachment portion may be adapted to the upper portion of the inner surface 4 of the skirt portion 3 of the outer body member 2, or to the inner surface 8 of the base 6 or even to the portion of the shank 9 close to the base 6. In these cases, the skirt portion 3 is provided with means for engaging the stopper with the bottle neck.

The inner body 11 comprises also a hollow sealing member 17 adapted for insertion in the neck 15 of the bottle 16 to engage snugly the inner surface 18 of the neck and, therefore, form a tight seal. The axial shank 9 penetrates in the hollow member 17 such that the end 10 of the former engages the bottom 19 of the member 17.

Between the hollow sealing member 17 and the attachment portion (the latter possibly extended by an annular member 20) there is provided a plurality of bridge members 21 which either connect the attachment portion to the hollow member or, together with the annular member 20, aid such connection. Preferably such bridge members are of inverted U-shape, having a first leg 22 extending (upwardly in the normal vertical position of the bottle) from the annular member 20 towards the base 6 of the outer body member 2 and a second leg 23 which has its extension generally aligned with the sealing member 17 itself.

Figure 9:
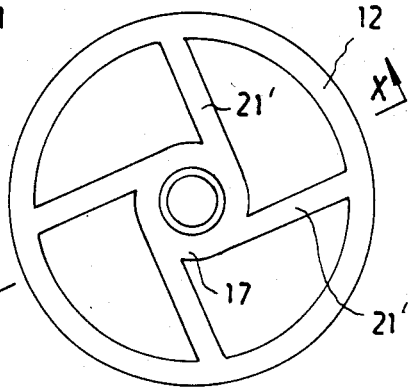
FIG. 9 is a plan view from above of another embodiment of the inner body member.
Figure 10:
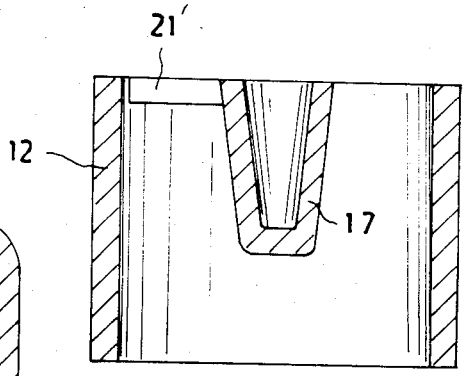
FIG. 10 is a cross sectional view along the line X—X of FIG. 9.
Figure 8:
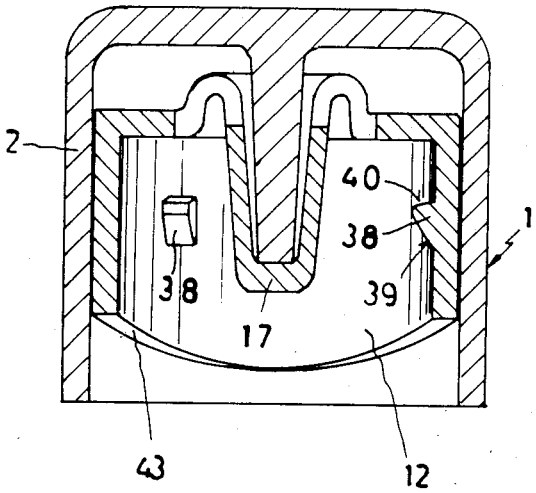
FIG. 8 is an axial cross sectional view of the stopper of FIG. 7, removed from the bottle.

The bridge members may be spaced apart, as in 26, or may be practically touching one another, by way of minimum thickness cuts. It is also contemplated that the bridge members have a practically constant width. The invention also contemplates the possibility of the bridge members not being inverted U-shaped (FIGS. 9 and 10) but that they are formed by generally straight bridge members 21'.

It is particularly contemplated that such bridge members 21' should not be oriented radially, but that they should extend from the skirt portion 12 to the sealing member 17 generally tangentially to the open end of this member. In this case, the rotation of the stopper when being screwed on the bottle neck provides a twist to the member 17, improving its sealing effect.

In actual practice, glass bottles are often faulty in the sense that the inner bore of the neck is off centre or the orifice is oval and both faults may coexist. With the shape described, the hollow sealing member 17 is provided with a great capacity of adaptation to the inner surface of the neck 15, even when this is irregular, since the bridge members 21 are capable of flexing unevenly, to fit any slope and/or off centre position of the bottle neck inner bore.

As stated above, the hollow sealing member 17 fits snugly in the inner surface 18 of the neck. This causes the hollow member to be restrained on being inserted in the neck. If the downward movement (in the sense of the Figures) of the stopper 1 is excessive, an undesired stress is produced between the hollow member 17 (restrained by the neck) and the shank 9, which may be harmful for the hollow member.

It is therefore of interest to regulate the downward movement of the stopper 1. Furthermore, preferably for ornamental reasons, it is also desirable that the stopper 1 should adopt a particular position relative to the bottle 16.

To attain both ends together and at the same time to apply the stopper to the neck, it is contemplated that the inner surface 14 of the skirt portion 12 of the inner body member 11 is provided with inwardly directed means adapted to engage other means on the neck 15.

Thus the neck is provided with thread means 30 and also a circular bead 31, there being provided between the thread means and the bead axial ribs 32 acting as stops for the rotation of the inner body member means. When the inner body stops rotation, the insertion of the stopper also stops and thus the above mentioned undesirable stress is not generated and the stopper is also correctly positioned relative to the bottle.

The inwardly directed means are formed by a thread 33 or by one or various segments 34 of an ideal annular thread. In the former case, the end 35 of the thread is provided with a generally radially disposed surface 36 so as to abut the corresponding axial rib 32. In turn, the segments 34 of the ideal annular thread are also provided with a generally radial lateral surface 37.

The thread means 30 of the neck are formed by a single helical thread or several helical threads spaced apart by the number of sexagesimal degrees resulting from dividing 360 by the number of threads.

The engagement between the stopper and the bottle may also be attained by protuberances 38 on the inner surface of the skirt portion 12 in the engagement with an annular recess of the neck 15. The protuberances 38 are preferably spaced apart equidistantly and they are generally sawtoothed in shape, i.e. they are provided with a gently sloping surface 40 and a further sharply sloping surface 41, so that the first surface shall not hinder the access of protuberance 38 in the recess 39, while the second surface tends to retain the protuberance on the neck.

To obtain the desired relative positioning, the neck 15 is provided with a peripheral shelf 42 which is undulating and adapted to be engaged by the free edge 43 of the skirt portion 12 which is also undulating. When the bottle is closed, on rotating the stopper, both undulating surfaces slide along an inclined plane providing an upward component of force allowing the resistance of the protuberance 38 on leaving the recess 39 to be overcome.

What I claim is:

1. A stopper for bottles having a neck and comprising a cup shaped outer body member having a lateral skirt member, a base portion and an axial shank extending from the inner portion of the base portion in the centre thereof; and a resilient inner body member comprising a portion for attachment to the outer body member and a hollow sealing member within which there is inserted said axial shank and which is adapted to be inserted in the neck, characterized in that a plurality of bridges extend between said attachment portion and said hollow member connecting said attachment portion and said hollow member.

2. A stopper as claimed in claim 1, characterised in that said bridge members are of inverted U-shape in axial cross section, each bridge member having a first leg directed upwardly towards the base portion of said outer body portion and a second leg directed downwardly towards said sealing member.

3. A stopper as claimed in claim 2, characterised in that each second leg of said bridge members is generally extended in the sealing member itself.

4. A stopper as claimed in claim 2, characterised in that said attachment portion is formed by a skirt portion juxtaposed with the inside of the outer body member and having a generally cylindrical inner surface.

5. A stopper as claimed in claim 4, characterised in that said sealing member is frustoconical.

6. A stopper as claimed in claim 4, characterised in that the inner surface of the skirt portion of the inner body member is provided with inwardly directed means adapted to engage thread means on the bottle neck, said neck having also at least one axial rib adapted to limit the rotation of said inwardly directed means as a stop member.

7. A stopper as claimed in claim 6, characterised in that said inwardly directed means comprise a thread.

8. A stopper as claimed in claim 6, characterised in that said inwardly directed means comprise one or several segments of an annular thread.

9. A stopper as claimed in claim 6, characterised in that said thread means comprise a single helical thread.

10. A stopper as claimed in claim 6, characterised in that said thread means comprise several helical threads spaced apart in a number of degrees resulting from dividing 360° by the number of threads.

11. A stopper as claimed in claim 4, characterised in that the inner surface of the skirt portion of the inner body member is provided with at least two generally sawtooth shape protuberances, adapted to engage an annular recess of the bottle neck, said neck having furthermore an undulating peripheral shelf adapted to be engaged by the free edge of the skirt portion which is also undulating.

* * * * *